US005726674A

United States Patent [19]

Greve

[11] Patent Number: 5,726,674

[45] Date of Patent: Mar. 10, 1998

[54] PHASE MODULATION TECHNIQUE FOR DRIVING RMS RESPONDING LIQUID CRYSTAL DISPLAYS

[75] Inventor: David A. Greve, Cedar Rapids, Iowa

[73] Assignee: Rockwell International Corporation, Costa Mesa, Calif.

[21] Appl. No.: 518,439

[22] Filed: Aug. 23, 1995

[51] Int. Cl.[6] ..... G09G 3/36

[52] U.S. Cl. ..... 345/94; 345/53

[58] Field of Search ..... 345/91, 50, 87, 345/92, 94, 95, 96, 97, 89, 51, 53; 359/60, 54, 56, 57, 58; 349/33, 34

[56] References Cited

U.S. PATENT DOCUMENTS

| | | | |
|---|---|---|---|
| 4,427,978 | 1/1984 | Williams | 345/89 |
| 4,724,433 | 2/1988 | Inoue et al. | 345/87 |
| 4,810,059 | 3/1989 | Kuijk | 345/97 |
| 5,379,050 | 1/1995 | Annis et al. | 345/91 |
| 5,459,495 | 10/1995 | Scheffer et al. | 345/89 |

*Primary Examiner*—Chanh Nguyen

*Attorney, Agent, or Firm*—Kyle Eppele; L. Keith Stephens; James P. O'Shaughnessy

[57] ABSTRACT

A passive matrix liquid crystal display and a method of driving the same are provided. A desired RMS voltage to be achieved during a first frame is determined for each pixel element of the display. A modulation coefficient is determined for each pixel element as a function of the desired RMS voltage for the pixel element during the first frame. For each cycle of the frame, a phase delay is determined for each column drive waveform as a function of the sum, over all rows, of the product of each modulation coefficient of a pixel element in the column and the phase delay of the corresponding row drive waveform during the cycle.

5 Claims, 5 Drawing Sheets

600
DATA
640
COLUMN DRIVER CONTROLLER
DATA
620
ROW DRIVER CONTROLLER
630
COLUMN DRIVERS
100
610
ROW DRIVERS
LCD PANEL

PHASE MODULATION TECHNIQUE FOR DRIVING RMS RESPONDING LIQUID CRYSTAL DISPLAYS

BACKGROUND OF THE INVENTION

The present invention relates generally to liquid crystal displays (LCDs), and more particularly to a method of driving RMS responding passive matrix LCDs.

Passive matrix liquid crystal displays (PMLCDs) have a matrix of liquid crystal pixel elements, with each pixel element coupled between one of the column conductors and one of the row conductors. Each pixel element is charged to the voltage differential between its associated column conductor and its associated row conductor. In order to simultaneously charge different pixel elements in a particular row or column to separate RMS voltages, prior art PMLCDs utilize complex drive techniques to drive all of the pixel elements of the display simultaneously. These techniques are sometimes referred to as "active addressing" or a "multi-line addressing" techniques. Previous implementations of these techniques involve amplitude modulation of the column drive voltages.

In these implementations, each frame is divided into sub-units of time known as cycles. The column drive signals for each cycle are assigned voltage values derived as a function of the weighted sum of all of the row signals' voltage values. This technique has several disadvantages. First, the most general solutions to the column functions are quadratic in nature, and can thus be very complex and difficult to implement. Further, the column drivers needed to implement this technique must be capable of driving the columns with high voltage resolution over a wide dynamic range.

Consequently, the need exists for a PMLCD and drive method with simplified column and/or row drivers which drive the pixel elements of the display to desired RMS voltages without requiring a wide drive voltage operating range and high drive voltage resolution.

SUMMARY OF THE INVENTION

It is an object of the present invention to provide an improved method of driving RMS responding PMLCDs. It is a second object of the present invention to provide a PMLCD having simplified column drivers. It is a third object of the present invention to provide a method of driving a PMLCD with bi-level voltage pulses. The present invention achieves these and other objects discussed throughout this application.

A passive matrix liquid crystal display and a method of driving the same are provided. A desired RMS voltage to be achieved during a first frame is determined for each pixel element of the display. A modulation coefficient is determined for each pixel element as a function of the desired RMS voltage for the pixel element during the first frame. For each cycle of the frame, a phase delay is determined for each column drive waveform as a function of the sum, over all rows, of the product of each modulation coefficient of a pixel element in the column and the phase delay of the corresponding row drive waveform during the cycle.

BRIEF DESCRIPTION OF THE DRAWINGS

The invention may be more fully understood by reading the following description of preferred embodiments of the invention in conjunction with the appended drawings wherein.

DETAILED DESCRIPTION OF THE PREFERRED EMBODIMENTS

A. Overview

The present invention is an RMS responding PMLCD with bi-level voltage column and row drivers and a method of operating the same. Sequences of bi-level voltage pulses of constant duration are phase modulated to drive the pixel elements of the display to achieve the desired RMS voltages. Because the bi-level voltage signals can be very near digital logic levels, the method of the present invention can be implemented with lower cost column and/or row drivers than prior art systems. Additionally, the disclosed phase modulation method of driving RMS responding PMLCDs results in a reduction of computational complexity in the derivation of the column drive signals.

Figure 1:
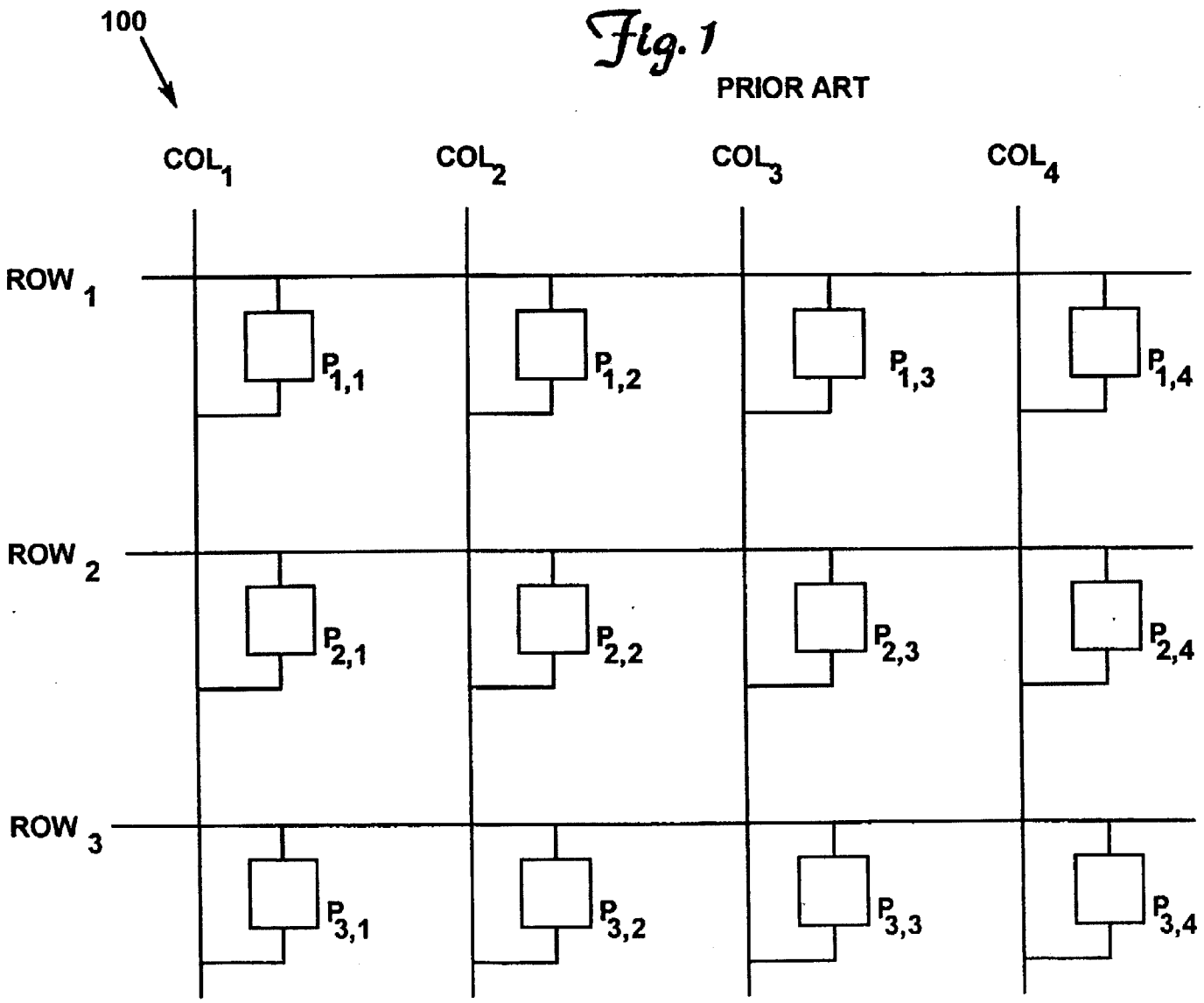
Fig. 1 PRIOR ART
FIG. 1 is a diagrammatic view of a passive matrix liquid crystal display panel of the type well known in the art.

FIG. 1 is a diagrammatic view illustrating PMLCD panel 100 of the type well known in the art. Panel 100 includes a large number of row conductors (only $ROW_1$, $ROW_2$ and $ROW_3$ are shown) and a large number of column conductors (only $COL_1$, $COL_2$, $COL_3$ and $COL_4$ are shown) oriented perpendicular to the row conductors. A matrix of pixel elements are arranged in rows and columns across panel 100 such that each individual pixel element $P_{i,j}$ (where i denotes the row number and j denotes the column number) is coupled between one row conductor and one column conductor. For example, pixel element $P_{3,4}$ is coupled between $ROW_3$ and $COL_4$. The present invention includes a method of driving the pixel elements with phase modulated bi-level voltage waveforms to achieve different RMS voltages on different pixel elements in the same row and/or column during a unit of time known as a frame.

Figure 2:
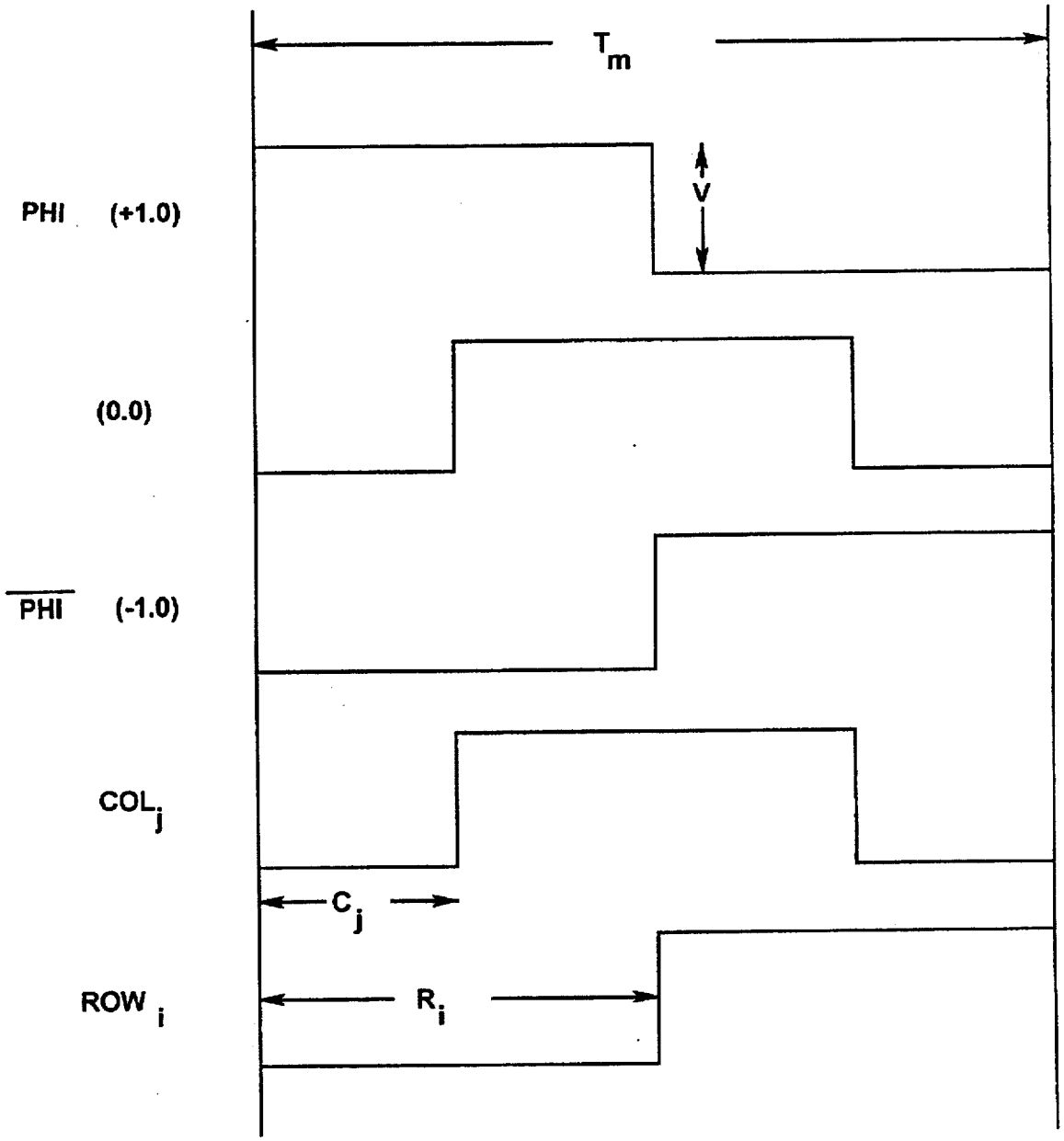
FIG. 2 is a timing diagram illustrating various phase delays of bi-level voltage drive waveforms out of a range of possible phase delays used in accordance with preferred embodiments of the present invention.

FIG. 2 is a timing diagram which illustrates various phase modulated drive waveforms used in accordance with embodiments of the present invention. The drive method of the present invention utilizes phase differences between bi-level waveforms on a particular column conductor and a particular row conductor (e.g., between the waveforms driving conductors $COL_1$ and $ROW_1$) to create appropriate RMS voltages across the associated pixel element (e.g., $P_{1,1}$) in an RMS responding LCD. Each time period $T_m$ represents the length of one cycle, where each cycle is a sub-unit of a larger unit of time referred to above as a frame. A frame is typically a predetermined number of cycles in duration, with one voltage pulse generated per cycle, and is the time period during which the desired RMS voltages across individual pixel elements are achieved and maintained. The desired RMS voltage across any particular pixel element can be changed from one frame to the next. Note that in preferred embodiments, the widths of all column and/or row drive pulses are the same, with only the phase delays (i.e., the leading edge of each pulse relative to the beginning of its cycle) changing.

The first three waveforms at the top of FIG. 2 are included to illustrate a few of the various possible phase delays. The waveform labeled PHI represents a totally "in-phase" drive waveform. For the sake of clarity and illustration, the phase delay for PHI is arbitrarily referred to as being a phase delay of plus one (+1.0). The waveform labeled $\overline{\text{PHI}}$ represents a totally "out-of-phase" waveform. The phase delay for $\overline{\text{PHI}}$ is referred to as being a phase delay of minus one (−1.0). A waveform having an intermediate phase delay (designated as a phase delay of 0.0 in the example shown) between the phase delay of PHI and the phase delay of $\overline{\text{PHI}}$ is included to illustrate the mid-point of the continuum of possible phase delays between PHI and $\overline{\text{PHI}}$.

Although in some preferred embodiments a continuum of phase delays are used, in at least one contemplated embodiment, a finite number of discrete phase delays are used. In either case, the phase delay of any voltage pulse on a row or column conductor will fall on or between the arbitrarily defined phase delays of PHI and $\overline{\text{PHI}}$. The phase delay of the voltage pulse on a column conductor is denoted as $C_j$. For example, the phase delay on $COL_1$ is denoted $C_1$. In preferred embodiments, the phase delays $R_i$ of the voltage pulses on row conductors are equal to either PHI or $\overline{\text{PHI}}$. However, in other embodiments, the range of values of phase delays $R_i$ of the voltage pulses on the row conductors are also between PHI and $\overline{\text{PHI}}$.

The present invention is based partially upon the recognition that, during the cycles of a frame and given a waveform (e.g., a row driver waveform) which is a sequence of pulses each having a phase delay between −1.0 and +1.0, a second waveform (e.g., a column driver waveform) can be generated for the frame such that the RMS voltage between the two waveforms achieves a value between zero volts and some fraction of V, where V is the voltage difference between the high and low values of the bi-level waveforms. In other words, given a phase modulated drive function on a particular row conductor, a phase modulated drive function can be determined for a corresponding column conductor which will charge the pixel element coupled between the two conductors to a desired RMS gray scale voltage during the cycles of a frame. The row and column drive functions will each include a series of pulses (one pulse per cycle), with each pulse being of uniform duration and having a phase delay modulated to a desired value between −1.0 and +1.0. Further, given this type of drive function for each of the row conductors, drive functions for each of the column conductors can be determined such that all pixel elements of the display panel are simultaneously charged to their respective desired RMS voltages during the frame.

One possible bi-level phase modulation drive method has been described generally above, and is explained in further detail below. However, the present invention is not limited to this specific embodiment of the phase modulation method of driving an RMS responding PMLCD. Rather, the present invention is intended to include phase modulation methods of implementing multi-line addressing techniques of driving RMS responding PMLCDs in general.

The expression for the RMS voltage of a particular pixel element charged between two drive signals over one cycle of duration $T_m$ can be shown to be:

$$U_{i,j}^2 = \frac{V^2\left(\frac{1-R_iC_j}{2}\right)T_m}{T_m} \qquad \text{Equation 1}$$

where:

$U_{i,j}$ is the RMS voltage of pixel element $P_{i,j}$ coupled between $ROW_i$ and $COL_j$;

$R_i$ is the phase delay of the drive signal on conductor $ROW_i$ during the cycle and has a value such that $R_i \epsilon \{+1,-1\}$;

$C_j$ is the phase delay of the drive signal on conductor $COL_j$ during the cycle and has a value such that $-1 \leqq C_j \leqq +1$; and V is the amplitude of the row and column drive signals (or the magnitude of the difference between the high and low voltage levels of the drive waveforms).

The expression for $U_{i,j}$ shown in Equation 1 illustrates a significant difference between the phase modulation method of the present invention and prior art voltage or amplitude modulation methods. The column phase modulation factor is linear in $C_j$ in the method of the present invention, while the column amplitude modulation factor is quadratic in prior art techniques. This results in significant simplification in the computation of the column drive signal waveforms as compared to prior art methods.

The column phase at any time for a particular column drive function or waveform can be expressed as the sum over each of the pixel elements (rows) in the column of the product of a modulation coefficient and the associated row function. This is shown in Equation 2 below.

$$C_j(t) = \sum_{i=1}^{M} a_{i,j}R_i(t) \qquad \text{Equation 2}$$

where:

t is a variable representative of the current cycle;

$C_j(t)$ is the column signal function for $COL_j$ and is indicative of the phase delay of the voltage pulse on $COL_j$ during cycle t;

$a_{i,j}$ is the modulation coefficient for pixel element $P_{i,j}$ in $COL_j$; and $R_i(t)$ is the row signal function for $ROW_i$ and is indicative of the phase delay of the voltage pulse on $ROW_i$ during cycle t.

Modulation coefficient $a_{i,j}$ for each pixel element $P_{i,j}$ can be expressed as a function of desired RMS voltage $U_{i,j}$ for the pixel element during a given frame as shown in Equation 3.

$$a_{i,j} = 1 - 2\left[\frac{U_{i,j}}{V}\right]^2 \qquad \text{Equation 3}$$

Figure 3:
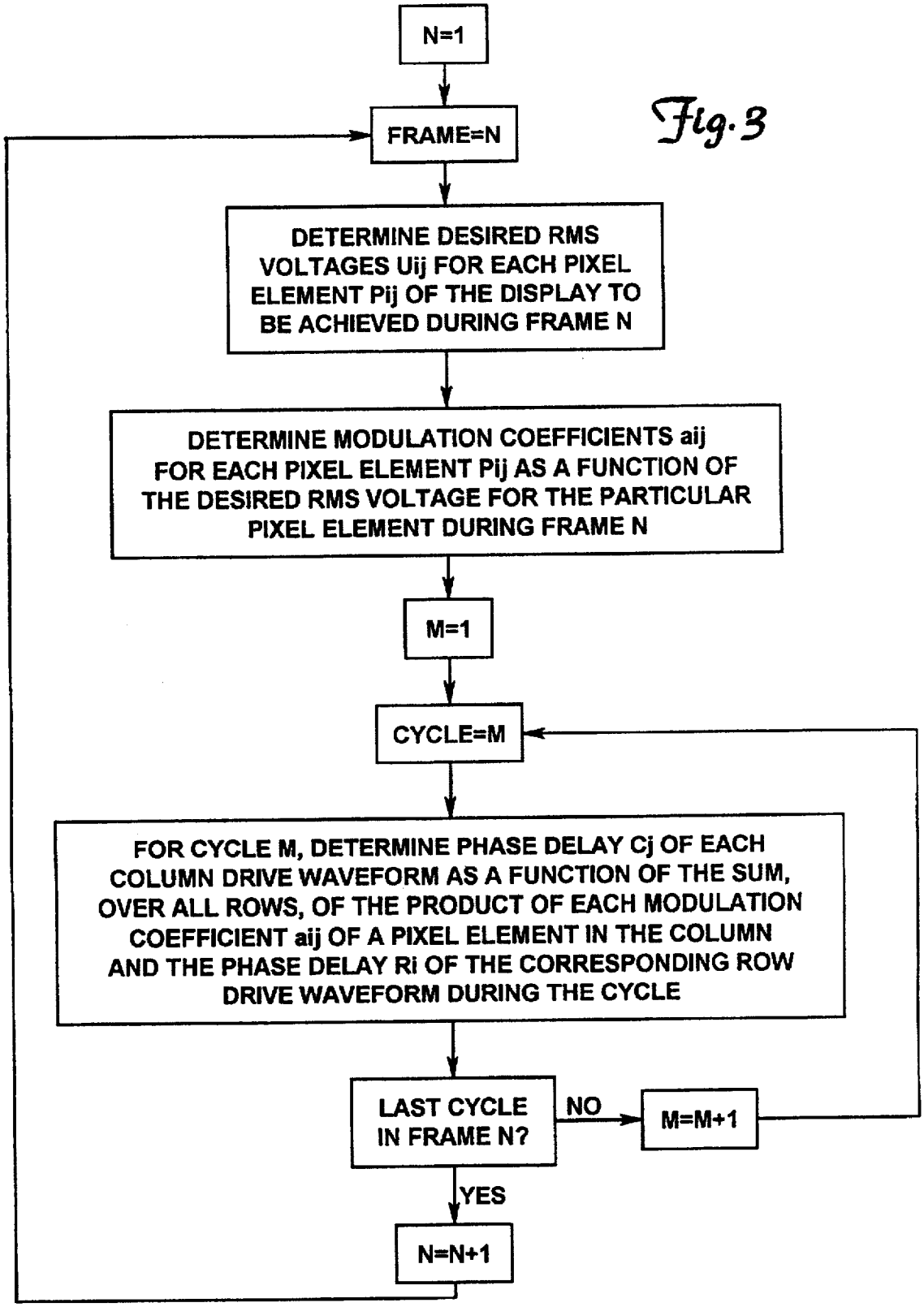
FIG. 3 is a flow chart illustrating one preferred embodiment of the method of the present invention.

Using the above relationships, in one preferred embodiment of the present invention, the column drive waveforms are determined as follows. First, for a particular frame, desired RMS voltages $U_{i,j}$ for each pixel element $P_{i,j}$ of the PMLCD are determined. Next, modulation factor $a_{i,j}$ for each pixel element $P_{i,j}$ is determined for the frame in a manner such as illustrated in Equation 3. Then, since the phase delays of the row conductors during each cycle of the frame are known and representable as functions $R_i(t)$, column drive functions $C_j(t)$ (phase delays) for each cycle of the frame can be determined in a manner such as illustrated in Equation 2. The column drive function obtained for each column will control and be indicative of the phase delay on the column conductors during each cycle of the frame. One embodiment of the preferred method of the present invention is illustrated in the flowchart of FIG. 3. However, the present invention is not limited to the method specifically illustrated in FIG. 3. Rather, the present invention includes numerous adaptations of the phase modulation drive technique.

B. Preferred Implementation

The method of the present invention relies upon the difference between the arrival of the leading edges of row and column drive pulses at particular pixel element locations. It is recognized that because it takes time for the signals to traverse the display, the actual time differences between the arrival at particular pixel element locations of the leading edges of the row and column drive pulses may vary from the intended time differences at different locations on the display. Therefore, if the time differences vary significantly, launch times of the various row and column drive waveforms can be delayed by varying additional amounts to help assure that the actual time differences between the arrival of the leading edges of the pulses at particular pixel element locations are the same as the intended time differences.

It is known that the inherent resistances and capacitances of the column and row conductors cause degradation of the shape of the applied waveforms over the width of the display. It has been observed that a majority of the degradation of a square wave pulse occurs within the first few pixel elements. Therefore, by applying pre-degraded waveforms to the row and column conductors, the difference due to degradation of the waveforms at various pixel element locations across the display can be minimized. This will result in a more uniform image across the display.

The methods of the present invention work best under the assumption that the mean square voltage is linear in the phase delay between the two drive signals as shown in Equation 1. However, it is recognized that the mean square voltage is non-linear between two non-square wave pulses, such as result from the above described waveform degradation. It is believed that these non-linearities can be compensated for by first identifying the non-linearity. Next, the inverse of the non-linearity, or its closest approximation, must be identified. Then, the identified inverse is applied to the calculated column phase to obtain a compensated phase, which can be applied to the display to obtain the desired results.

Figure 4:
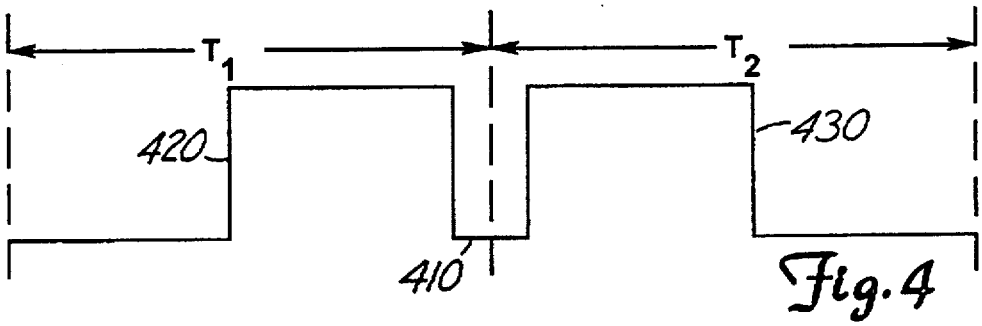
FIG. 4 is a timing diagram which illustrates the occurrence of an intercycle pulse.

A well known draw back of temporal modulation techniques is that pulses of short duration will tend to be filtered out as they traverse the display, resulting in non-uniformity. Despite the present inventions preferred use of uniform width pulses of a sufficiently large duration, short intercycle pulses can still arise. As illustrated in FIG. 4, intercycle pulse 410 having a short duration can be generated at the boundaries between two consecutive cycles $T_1$ and $T_2$ of duration $T_m$. This occurs if the phase delay of pulse 420 in cycle $T_1$ is very near −1.0 ($\overline{PHI}$) and the phase delay of pulse 430 in cycle $T_2$ is very near +1.0 (PHI). The present invention minimizes or eliminates the occurrence of intercycle pulses by using return to zero (RTZ) waveforms or return to one (RTO) waveforms.

Figure 5A:
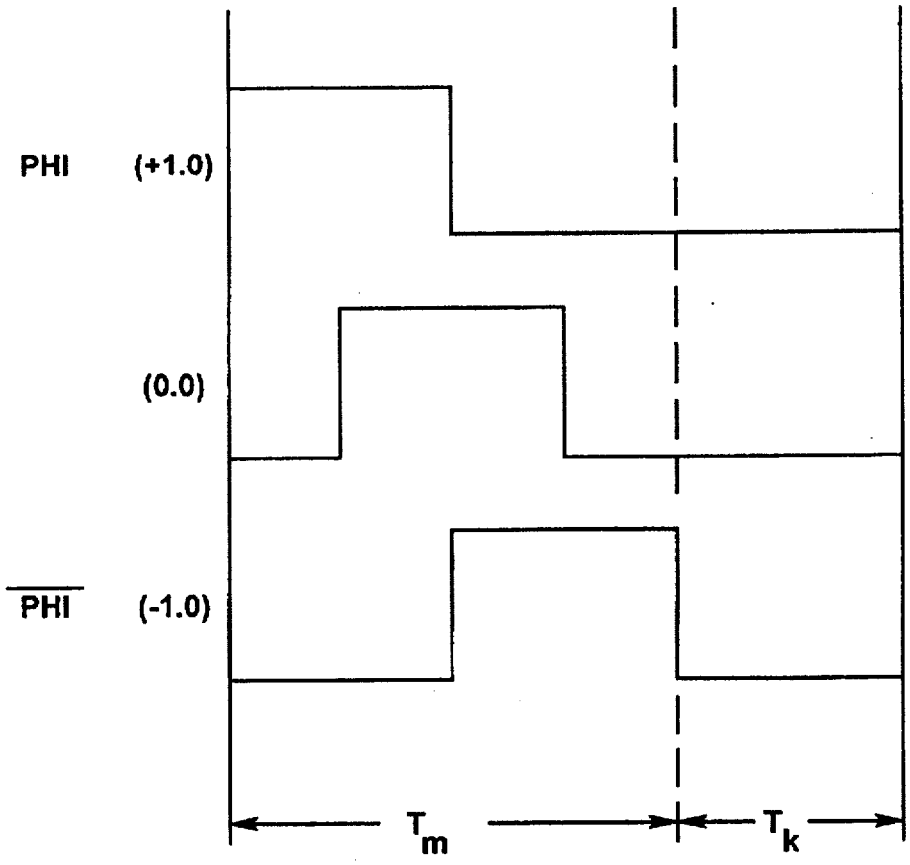
FIGS. 5A and 5B illustrate return-to-zero (RTZ) waveforms used in accordance with preferred embodiments of the present invention to minimize the occurrence of intercycle pulses of the type illustrated in FIG. 4.
Figure 5B:
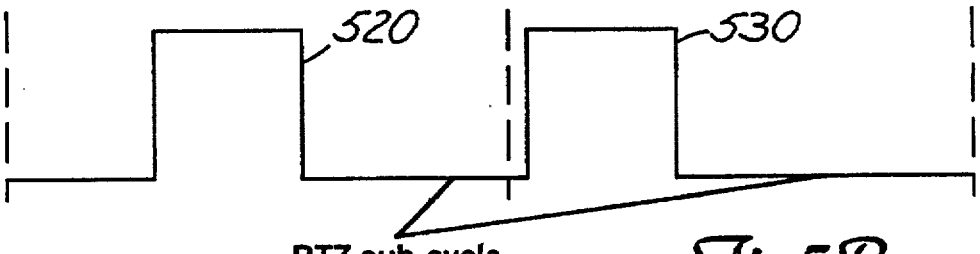

FIGS. 5A and 5B illustrate the use of RTZ waveforms to prevent or minimize the occurrence of intercycle pulses. In FIG. 5A, the PHI, $\overline{PHI}$ and intermediate phase delay pulses illustrated in FIG. 2 are shown in an RTZ waveform format. These pulses are identical to the corresponding pulses shown in FIG. 2, except with the addition of the RTZ sub-cycle during time period $T_k$. In other words, the length of each cycle is increased from time period $T_m$ to time period $T_m$ plus time period $T_k$. During each entire sub-cycle $T_k$, the waveform is maintained at the low voltage level so that short duration intercycle pulses cannot occur. This is further illustrated in FIG. 5B where consecutive pulses 520 and 530, which otherwise would result in the occurrence of an intercycle pulse due to their associated phase delays in their respective cycles, are sufficiently spaced apart by the RTZ sub-cycle portion of the first cycle to prevent the occurrence of such an intercycle pulse. RTO waveforms operate under the same concept as RTZ waveforms, except that the entire waveform is inverted.

When using RTZ (or RTO) waveforms as described above, the expression for modulation coefficient ai,j described in Equation 3 changes to the expression shown below in Equation 4.

$$a_{i,j} = 1 - 2(1+k)\left[\frac{U_{i,j}}{V}\right]^2 \qquad \text{Equation 4}$$

where, $$k = \frac{T_k}{T_m} \qquad \text{Equation 5}$$

Figure 6:
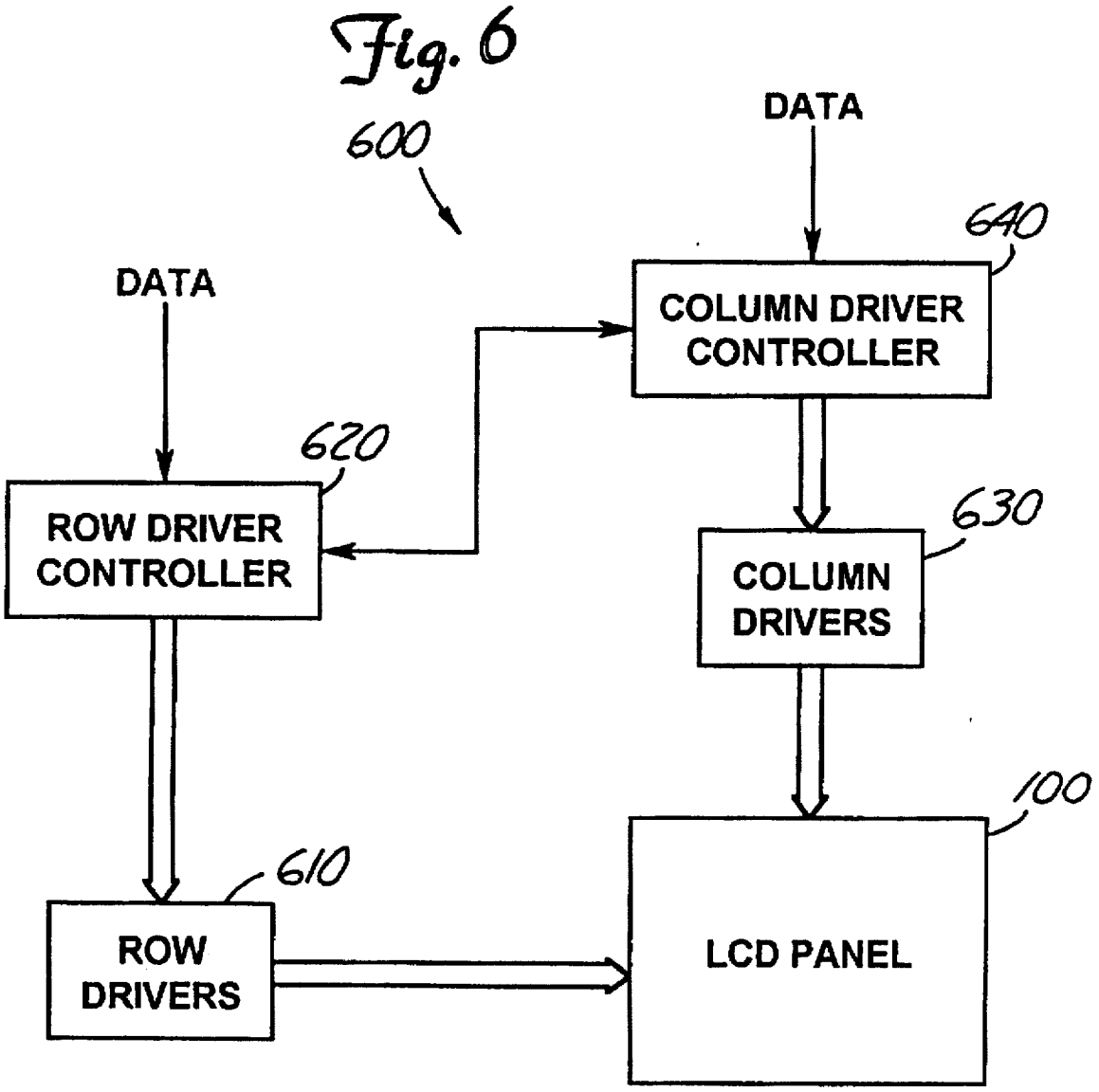
FIG. 6 is a block diagram illustrating a PMLCD having column and row drivers and controllers which function according to the preferred methods of the present invention.

FIG. 6 is a block diagram illustrating one possible PMLCD configuration which employs the phase modulation method of the present invention. PMLCD 600 utilizes the method of the present invention, as illustrated in one embodiment in the example flow diagram of FIG. 3, to drive panel 100. PMLCD 600 includes LCD panel 100, row drivers 610, row driver controller 620, column drivers 630, and column driver controller 640. Row driver controller 620 generates control signals, in response to received data, which control the phase delays of the row drive waveforms generated by row drivers 610 during each cycle of each frame. In preferred embodiments, row driver controller 620 controls row drivers 610 such that the drive waveform on each row during each cycle has a phase delay of PHI (+1.0) or $\overline{PHI}$ (−1.0).

Column driver controller 640 generates control signals, in response to received data, which control the phase delays of the column drive waveforms generated by column drivers 630 during each cycle of each frame. In preferred embodiments, the data input to column driver controller 640 is indicative of the desired RMS voltage for each pixel element $P_{i,j}$ during a particular frame, and of the phase delays of the row drive waveforms during each cycle of the frame. Column driver controller 640 then determines modulation coefficients $a_{i,j}$ for each pixel element $P_{i,j}$ for the frame as a function of the desired RMS voltage of the pixel element during the frame. Next, column driver controller 640 determines the phase delays, for each cycle, of each column drive waveform as functions of the modulation coefficients of pixel elements in the respective columns and of the phase delays of the row drive waveforms during the cycle. In preferred embodiments, controllers can be microprocessors, programmable logic controllers or any other digital or analog circuitry capable of generating control signals to control row drivers 610 and column drivers 630 in the intended manner.

While particular embodiments of the present invention have been shown and described, it is clear that changes and modifications may be made to such embodiments without departing from the true scope and spirit of the invention. For example, the phase modulated bi-level pulses used in embodiments of the present invention could, in yet other embodiments, have variable durations to at least some extent. In fact, the phase modulation method of the present invention can be adapted to include aspects of voltage (pulse height) modulation and pulse width modulation techniques without departing from the scope of the invention. Further, even though the method of the present invention is described with reference to the column and row conductors each being driven in a particular manner, it is clear that the column and row conductors can be interchanged in implementations of the present invention. Although these and other adaptations are not currently deemed the preferred embodiment of the present invention, it is intended that the appended claims cover all such changes and modifications.

I claim:

1. A method of driving a passive matrix LCD during a first time period, the passive matrix LCD having a plurality of row conductors, a plurality of column conductors, and a plurality of pixel elements, each of the plurality of pixel elements being coupled between one of the plurality of row conductors and one of the plurality of column conductors, the first time period being divided into a plurality of time sub-periods, each of the plurality of row conductors being driven with one of a plurality of first drive waveforms during the first time period such that each of the plurality of pixel elements has a row drive waveform associated therewith, each of the plurality of first drive waveforms having a phase delay during each of the time sub-periods of the first time period, the method comprising:

determining a desired RMS voltage, for each of the plurality of pixel elements, to be achieved during the first time period;

determining a modulation coefficient for each of the plurality of pixel elements as a function of the desired RMS voltage for the particular pixel element during the first time period;

determining phase delays for each of plurality of second drive waveforms for each time sub-period of the first time period, each of the plurality of second drive waveforms being associated with one of the plurality of column conductors, wherein each phase delay for each time sub-period for a particular one of the plurality of second drive waveforms is determined as function of the modulation coefficients of each pixel element coupled to the associated column conductor and as a function of the phase delays of each of the plurality of first drive waveforms during the particular time sub-period; and driving each of the plurality of column conductors with the associated one of the plurality of second drive waveforms during the time sub-periods of the first time period to achieve the desired RMS voltages at each of the plurality of pixel elements;

wherein determining phase delays for each of the plurality of second drive waveforms for each time sub-period of the first time period further comprises determining phase delays for each of the plurality of second drive waveforms for each time sub-period of the first time period as a function of the sum of the product of each modulation coefficient of a pixel element coupled to the associated column conductor and the phase delay of the associated row drive waveform during the particular time sub-period.

2. The method of claim 1 wherein driving each of the plurality of column conductors with the associated one of the plurality of second drive waveforms comprises driving each of the plurality of column conductors with an associated one of a plurality of bi-level voltage pulses during each of the time sub-periods, each bi-level voltage pulse having the phase delay determined for the corresponding one of the plurality of second drive waveforms.

3. The method of claim 2 wherein driving each of the plurality of column conductors with an associated one of a plurality of bi-level voltage pulses comprises driving each of the plurality of column conductors with a return-to-zero bi-level voltage pulse.

4. The method of claim 2 wherein driving each of the plurality of column conductors with an associated one of a plurality of bi-level voltage pulses comprises driving each of the plurality of column conductors with a return-to-one bi-level voltage pulse.

5. A method of driving a passive matrix LCD during a first time period, the passive matrix LCD having a plurality of row conductors, a plurality of column conductors, and a plurality of pixel elements, each of the plurality of pixel elements being coupled between one of the plurality of row conductors and one of the plurality of column conductors, the first time period being divided into a plurality of time sub-periods, each of the plurality of row conductors being driven with one of a plurality of first drive waveforms during the first time period such that each of the plurality of pixel elements has a row drive waveform associated therewith, each of the plurality of first drive waveforms having a phase delay during each of the time sub-periods of the first time period, the method comprising:

determining a desired RMS voltage, for each of the plurality of pixel elements, to be achieved during the first time period;

determining a modulation coefficient for each of the plurality of pixel elements as a function of the desired RMS voltage for the particular pixel element during the first time period;

determining phase delays for each of plurality of second drive waveforms for each time sub-period of the first time period, each of the plurality of second drive waveforms being associated with one of the plurality of column conductors, wherein each phase delay for each time sub-period for a particular one of the plurality of second drive waveforms is determined as function of the modulation coefficients of each pixel element coupled to the associated column conductor and as a function of the phase delays of each of the plurality of first drive waveforms during the particular time sub-period; and driving each of the plurality of column conductors with the associated one of the plurality of second drive waveforms during the time sub-periods of the first time period to achieve the desired RMS voltages at each of the plurality of pixel elements;

wherein determining phase delays for each of the plurality of second drive waveforms for each time sub-period of the first time period further comprises determining phase delays for each of the plurality of second drive waveforms for each time sub-period of the first time period as a function of the sum of the product of the modulation coefficients of at least two pixel elements coupled to the associated column conductor and the phase delay of the associated row drive waveform during the particular time sub-period.

* * * * *